US011374385B2

(12) United States Patent
Shibata et al.

(10) Patent No.: US 11,374,385 B2
(45) Date of Patent: Jun. 28, 2022

(54) SPARK PLUG, NOBLE METAL TIP, AND MANUFACTURING METHOD FOR NOBLE METAL TIP

(71) Applicant: DENSO CORPORATION, Kariya (JP)

(72) Inventors: Masamichi Shibata, Kariya (JP); Hiroshi Nakao, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/132,331

(22) Filed: Dec. 23, 2020

(65) Prior Publication Data

US 2021/0203135 A1 Jul. 1, 2021

(30) Foreign Application Priority Data

Dec. 25, 2019 (JP) ..... JP2019-235116

(51) Int. Cl.
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
CPC ..... H01T 13/39; H01T 21/02; H01T 13/20; H01T 13/32
See application file for complete search history.

(56) References Cited

U.S. PATENT DOCUMENTS

2014/0049151 A1* 2/2014 Murayama ..... H01T 13/39 313/141
2018/0166863 A1* 6/2018 Sumoyama, Sr. ..... H01T 13/20
2019/0296526 A1 9/2019 Kikai et al.

FOREIGN PATENT DOCUMENTS

JP 2016-051635 4/2016

* cited by examiner

*Primary Examiner* — Kevin Quarterman
(74) *Attorney, Agent, or Firm* — Nixon & Vanderhye P.C.

(57) ABSTRACT

In a spark plug, a noble metal tip includes an Ir-alloy material and has a circular-columnar shape that has a predetermined outer diameter and is formed by the Ir-alloy material being stretched. The spark plug generates discharge between the noble metal tip and a ground electrode that is arranged to oppose an outer peripheral surface of the noble metal tip. The Ir-alloy material includes crystal grains of an Ir alloy having an average aspect ratio that is adjusted to be equal to or greater than 1.3 and equal to or less than 4.8. The average aspect ratio is an average value of aspect ratios of the crystal grains each being a value obtained by a length of the respective crystal grains in an axial direction of the noble metal tip being divided by a length of the respective crystal grains in a direction perpendicular to the axial direction.

12 Claims, 5 Drawing Sheets

COMPARATIVE EXAMPLE

EMBODIMENT

SPARK PLUG, NOBLE METAL TIP, AND MANUFACTURING METHOD FOR NOBLE METAL TIP

CROSS-REFERENCE TO RELATED APPLICATIONS

This application is based on and claims the benefit of priority from Japanese Patent Application No. 2019-235116, filed Dec. 25, 2019. The entire disclosure of the above application is incorporated herein by reference.

BACKGROUND

Technical Field

The present disclosure relates to a spark plug.

Related Art

A spark plug that includes a circular-columnar center electrode and an annular ground electrode is known. The ground electrode is arranged so as to oppose an outer peripheral surface of the center electrode. The spark plug generates discharge between the center electrode and the ground electrode.

SUMMARY

One aspect of the present disclosure provides a spark plug that includes a noble metal tip and a ground electrode. The noble metal tip includes an Ir-alloy material and has a circular-columnar shape that has a predetermined outer diameter and is formed by the Ir-alloy material being stretched. The ground electrode is arranged so as to oppose an outer peripheral surface of the noble metal tip. The spark plug is configured to generate discharge between the noble metal tip and the ground electrode. The Ir-alloy material includes crystal grains of an Ir-alloy having an average aspect ratio that is adjusted to be equal to or greater than 1.3 and equal to or less than 4.8. The average aspect ratio is an average value of aspect ratios of the crystal grains each being a value that is obtained by a length of the respective crystal grains in an axial direction of the noble metal tip being divided by a length of the respective crystal grains in a direction perpendicular to the axial direction.

DESCRIPTION OF THE EMBODIMENTS

Figure 1:
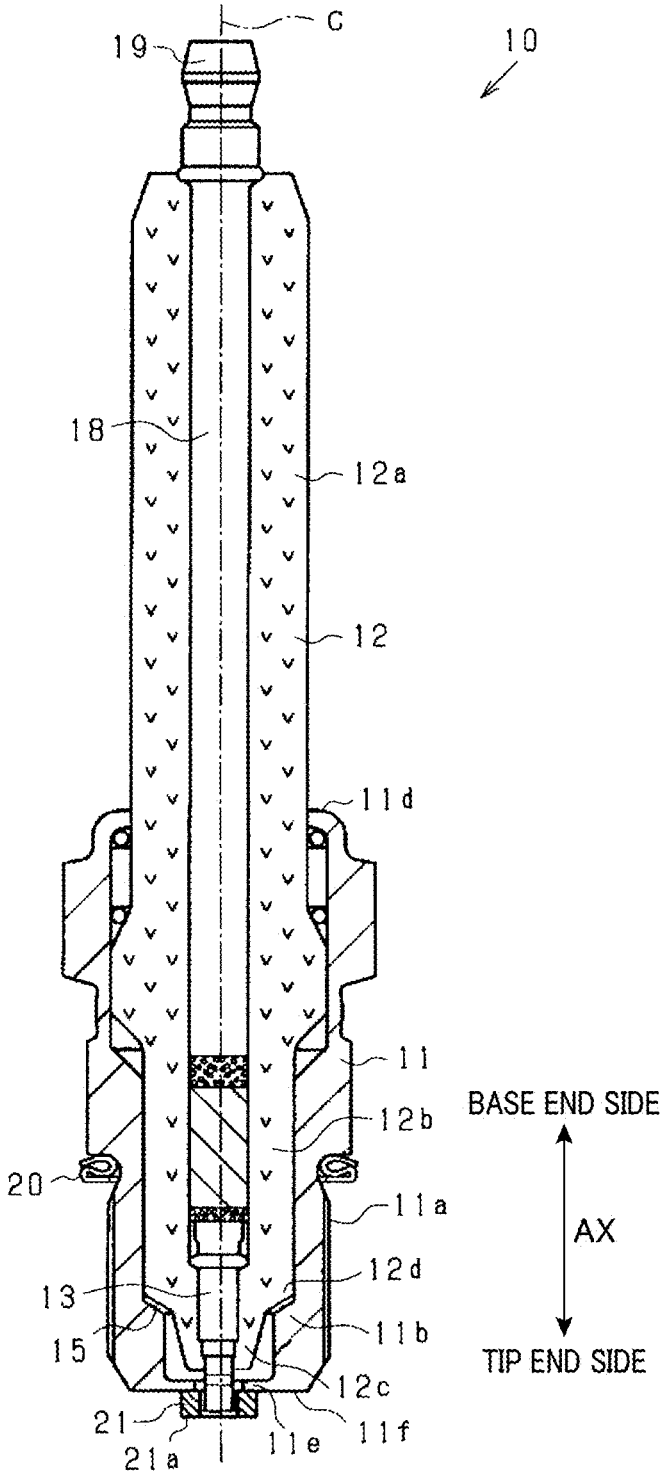
FIG. 1 is a cross-sectional view of a spark plug according to an embodiment.

Conventionally, there is a spark plug that includes a circular-columnar center electrode and an annular ground electrode that is arranged so as to oppose an outer peripheral surface of the center electrode (refer to JP-A-2016-051635). The center electrode may include a noble metal tip at a tip end thereof. The noble metal tip includes a noble metal and is formed into a circular-columnar shape. In this case, the annular ground electrode is arranged so as to oppose an outer peripheral surface of the noble metal tip.

In general, the circular-columnar noble metal tip is manufactured such that a circular-columnar material is stretched in an axial direction and an outer diameter dimension thereof is adjusted. The circular-columnar material is then cut such that a length in the axial direction is a prescribed length. Therefore, a crystal structure of the circular-columnar noble metal tip is in a form of fibers that run along the stretching direction.

In addition, the inventors of the present application have noticed that, through use of the spark plug, the outer peripheral surface of the noble metal tip becomes finely split. The fibrous structure come into contact with the ground electrode that opposes the outer peripheral surface. A short circuit may occur between the noble metal tip and the ground electrode.

It is thus desired to suppress, in a spark plug in which a ground electrode opposes an outer peripheral surface of a circular-columnar noble metal tip, a short circuit between the noble metal tip and the ground electrode.

A first exemplary embodiment provides a spark plug that includes: a noble metal tip that includes an Ir-alloy material and has a circular-columnar shape that has a predetermined outer diameter and is formed by the Ir-alloy material being stretched; and a ground electrode that is arranged so as to oppose an outer peripheral surface of the noble metal tip. The spark plug is configured to generate discharge between the noble metal tip and the ground electrode. The Ir-alloy material includes crystal grains of an Ir-alloy having an average aspect ratio that is adjusted to be equal to or greater than 1.3 and equal to or less than 4.8. The average aspect ratio is an average value of aspect ratios of the crystal grains each being a value that is obtained by a length of the respective crystal grains in an axial direction of the noble metal tip being divided by a length of the respective crystal grains in a direction perpendicular to the axial direction.

In the above-described configuration, the spark plug includes the noble metal tip in which an Ir-alloy material is stretched and formed into a circular-columnar shape that has a predetermined outer diameter, and a ground electrode that is arranged so as to oppose an outer peripheral surface of the noble metal tip. The spark plug generates discharge between the noble metal tip and the ground electrode.

Here, each of the aspect ratios is a value that is obtained by a length of the respective crystal grain in an axial direction of the noble metal tip being divided by a length of the crystal grain in a direction perpendicular to the axial direction. As described above, in general, the crystal structure of a circular-columnar noble metal tip is in the form of fibers that run along the stretching direction. Therefore, the average aspect ratio of the crystal grains is often equal to or greater than 10. When the noble metal tip is exposed to high temperatures through use of the spark plug, an oxide of Ir is formed in a grain boundary portion of the Ir alloy in the noble metal tip.

The inventors of the present application have noticed that, because the Ir oxide tends to be volatile at high temperatures, the outer peripheral surface of the noble metal tip may become finely split and a fibrous structure may come into contact with the ground electrode that opposes the outer peripheral surface. Here, a distance between the outer peripheral surface of the noble metal tip and the ground electrode is set to a distance that enables discharge to be appropriately performed, such as 0.2 mm to 0.7 mm.

In this regard, the average aspect ratio of the crystal grains of the Ir alloy in the noble metal tip is adjusted to be equal to or greater than 1.3 and equal to or less than 4.8. The aspect ratios of the crystal grains can be reduced by the noble metal tip that is formed by being stretched being subjected to a heating process and recrystallized. When the average aspect ratio of the crystal grains of the Ir alloy is equal to or less than 4.8, a holding force (a binding or cohesive force) between the crystal grains weakens compared to that when the average aspect ratio is equal to or greater than 10.

The inventors of the present application have found that, as a result, the structure that peels off from the surface of the noble metal tip detaches without coming into contact with the ground electrode. Therefore, a short circuit between the noble metal tip and the ground electrode can be suppressed.

Meanwhile, when the average aspect ratio of the crystal grains of the Ir alloy is less than 1.3, the inventors of the present application have found that the structure excessively peels off from the surface of the noble metal tip and the noble metal tip easily deteriorates. Therefore, as a result of the average aspect ratio of the crystal grains of the Ir alloy being adjusted to be equal to or greater than 1.3, deterioration of the noble metal tip can be suppressed.

According to a second exemplary embodiment, the average aspect ratio of the crystal grains of the Ir alloy in the noble metal tip is adjusted to be equal to or greater than 2.0 and equal to or less than 4.8. According to this configuration, peeling of the structure from the surface of the noble metal tip can be further suppressed. Deterioration of the noble metal tip can be further suppressed.

According to a third exemplary embodiment, in an initial state of the spark plug, a distance between the outer peripheral surface of the noble metal tip and the ground electrode is set to be equal to or greater than 0.25 mm and equal to or less than 0.6 mm.

The inventors of the present application have confirmed that the effects according to the first and second means are achieved when the distance between the outer peripheral surface of the noble metal tip and the ground electrode is any of 0.25 mm, 0.4 mm, and 0.6 mm in the initial state (at the start of use) of the spark plug. Therefore, in the spark plug in which the distance between the outer peripheral surface of the noble metal tip and the ground electrode is set to be equal to or greater than 0.25 mm and equal to or less than 0.6 mm in the initial state of the spark plug, a short circuit between the noble metal tip and the ground electrode can be suppressed.

Specifically, as according to a fourth exemplary embodiment, a configuration in which a length of the noble metal tip in the axial direction is equal to or greater than 2 mm and equal to or less than 4 mm can be used.

A fifth exemplary embodiment provides a noble metal tip that includes an Ir-alloy material. The noble metal tip has a circular-columnar shape that has a predetermined outer diameter is formed by the Ir-alloy material being stretched. The Ir-alloy material includes crystal grains of an Ir alloy having an average aspect ratio that is adjusted to be equal to or greater than 1.3 and equal to or less than 4.8. The average aspect ratio is an average value of aspect ratios of the crystal grains each being a value that is obtained by a length of the respective crystal grains in an axial direction of the noble metal tip being divided by a length of the respective crystal grains in a direction perpendicular to the axial direction.

In the above-described configuration, as a result of application to the spark plug according to any one of the first to fourth exemplary embodiments, deterioration of the noble metal tip can be suppressed while a short circuit between the noble metal tip and the ground electrode is suppressed.

According to a sixth exemplary embodiment, the average aspect ratio of the crystal grains of the Ir alloy in the noble metal tip is adjusted to be equal to or greater than 2.0 and equal to or less than 4.8.

As a result of the above-described configuration, peeling of the structure from the surface of the noble metal tip can be further suppressed and deterioration of the noble metal tip can be further suppressed.

Specifically, as according to a seventh exemplary embodiment, a configuration in which a length of the noble metal tip in the axial direction is equal to or greater than 2 mm and equal to or less than 4 mm can be used.

An eighth exemplary embodiment provides a method for manufacturing a noble metal tip having a circular-columnar shape from an Ir alloy. The method includes: stretching an Ir-alloy material, having a circular-columnar shape, in the axial direction to adjust an outer diameter to a predetermined outer diameter; recrystallizing the Ir-alloy material, by a heating process, to adjust an average aspect ratio of crystal grains of an Ir alloy of the Ir alloy material to be equal to or greater than 1.3 and equal to or less than 4.8, the average aspect ratio being an average value of aspect ratios of the crystal grains each being a value that is obtained by a length of the respective crystal grains in an axial direction of the noble metal tip being divided by a length of the respective crystal grains in a direction perpendicular to the axial direction; and cutting the Ir-alloy material, such that a length in the axial direction is a prescribed length, to form the noble metal tip.

In the above-described process, a circular-columnar, Ir-alloy material is stretched in the axial direction and the outer diameter of the Ir-alloy material is adjusted to a predetermined outer diameter. The Ir-alloy material is then recrystallized by the heating process, and an average aspect ratio of the crystal grains of the Ir alloy in the Ir-alloy material is adjusted to be equal to or greater than 1.3 and equal to or less than 4.8. In addition, the Ir-alloy material is cut such that the length in the axial direction is a prescribed length. The noble metal tip is thereby formed.

Consequently, the noble metal tip according to the sixth exemplary embodiment can be manufactured. Here, the Ir-alloy material of which the average aspect ratio of the crystal grains of the Ir alloy have been adjusted may be cut. Alternatively, the average aspect ratio of the crystal grains of the Ir alloy may be adjusted after the Ir-alloy material is cut.

According to a ninth exemplary embodiment, the Ir-alloy material is recrystallized by the heating process and the average aspect ratio of the crystal grains of the Ir alloy in the Ir-alloy material is adjusted to be equal to or greater than 2.0 and equal to or less than 4.8.

As a result of the above-described process, the noble metal tip according to the sixth exemplary embodiment can be manufactured.

Recrystallization of the Ir alloy starts at approximately 1000° C. However, when the temperature becomes higher than 1400° C., the speed of recrystallization of the Ir alloy becomes excessively fast.

In this regard, according to a tenth exemplary embodiment, in the heating process, the Ir-alloy material is heated to a temperature that is equal to or greater than 1000° C. and equal to or less than 1400° C. and recrystallized. Therefore, the Ir-alloy material can be recrystallized and the average aspect ratio of the crystal grains can be easily stabilized.

When the temperature at which the Ir-alloy material is heated is too low, the speed of recrystallization of the Ir alloy becomes slow. An amount of time required for the average aspect ratio of the crystal grains to be adjusted becomes long. Meanwhile, when the temperature at which the Ir-alloy material is heated is too high, the speed of recrystallization of the Ir alloy becomes excessively fast. The average aspect ratio of the crystal grains becomes unstable.

In this regard, according to an eleventh exemplary embodiment, in the heating process, the Ir-alloy material is heated to a temperature that is equal to or greater than 1100° C. and equal to or less than 1200° C. and recrystallized. As a result of the above-described process, the average aspect ratio of the crystal grains of the Ir alloy can be easily stabilized while increase in the amount of time required for the adjustment of the average aspect ratio can be suppressed.

An embodiment implemented in a spark plug that is used in an internal combustion engine for cogeneration will hereinafter be described with reference to the drawings. Here, the embodiment can also be implemented in a spark plug that is used in an internal combustion engine for automobiles.

As shown in FIG. 1, a spark plug 10 includes a housing 11, an insulator 12, a center electrode 13, a ground electrode 21, and the like. The housing 11 (main fitting) is formed into a circular-cylindrical (cylindrical) shape. The circular-cylindrical (cylindrical) insulator 12 is held inside the housing 11. A circular-columnar (columnar) center electrode 13 is held inside the insulator 12. A tip end of the center electrode 13 protrudes from a tip end of the insulator 12. The annular ground electrode 21 is fixed to a tip end of the housing 11.

The center electrode 13, the housing 11, the insulator 12, and the ground electrode 21 are coaxially arranged. That is, center axes of the center electrode 13, the housing 11, the insulator 12, and the ground electrode 21 coincide with a center axis C of the spark plug 10.

The housing 11 is formed from a metal material that includes a metal such as iron. A screw 11*a* is cut into an outer periphery of a lower portion of the housing 11. For example, an outer diameter of the screw 11*a* may be 14 mm. The housing 11 has a protruding portion 11*b* that protrudes in an annular shape in an inner-diameter direction.

The insulator 12 is molded with an insulating material such as alumina. The insulator 12 includes a first body portion 12*a*, a second body portion 12*b*, and a leg portion 12*c*. An annular step portion 12*d* is formed between the second body portion 12*b* and the leg portion 12*c*. An annular gasket 15 provides a seal between the step portion 12*d* and the protruding portion 11*b*. The housing 11 and the insulator 12 are integrally coupled by an upper end portion 11*d* of the housing 11 being crimped.

As is well known, a center axis portion 18 and a terminal portion 19 are electrically connected in an upper portion of the center electrode 13. An external circuit that applies a high voltage for spark generation is connected to the terminal portion 19. In addition, a gasket 20 that is used for attachment to the internal combustion engine is provided in an upper end portion of the screw 11*a* of the housing 11.

In a state in which the spark plug 10 is attached to a combustion chamber of the internal combustion engine, the center electrode 13 and the ground electrode 21 of the spark plug 10 are exposed to the combustion chamber. In addition, a direction from the terminal portion 19 to the ground electrode 21 is a direction towards a center of the combustion chamber.

In a tip end portion, the housing 11 has a small diameter portion 11*e* of which an inner diameter is smaller than that of other portions. In an axial direction (i.e., a direction of the center axis C, hereinafter referred to as the "axial direction AX") of the spark plug 10, a tip end surface 11*f* of the small diameter portion 11*e*, that is, the tip end surface 11*f* of the housing 11 is a planar surface that is perpendicular to the center axis C. In addition, in the ground electrode 21, an end surface (base end surface) on the housing 11 side and a tip end surface 21*a* that is an end surface on a side opposite the housing 11 are also planar surfaces.

Figure 3:
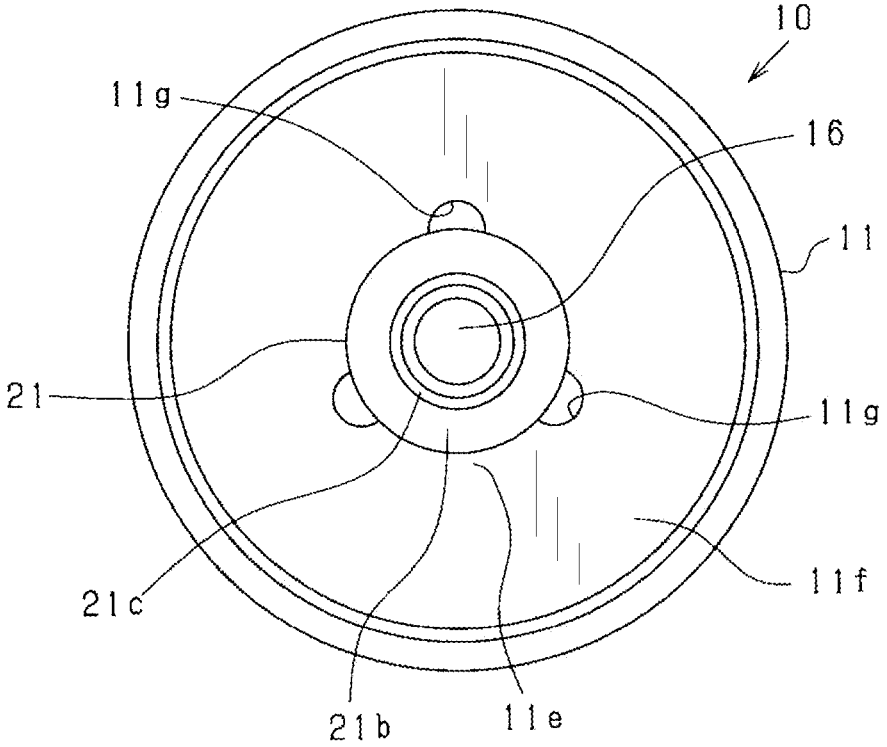
FIG. 3 is a plan view of the vicinity of the tip end of the spark plug according to the embodiment.

Furthermore, the ground electrode 21 is welded (joined) to the housing 11 in a state in which the tip end surface 11*f* of the small diameter portion 11*e* and the base end surface of the ground electrode 21 are in surface-to-surface contact. As shown in FIG. 3, three (a plurality of) ventilation holes 11*g* are formed in a portion of an inner peripheral edge portion of the small diameter portion 11*e*. The ventilation holes 11*g* communicate between an interior and an exterior of the housing 11 in the small diameter portion 11*e*.

Figure 2:
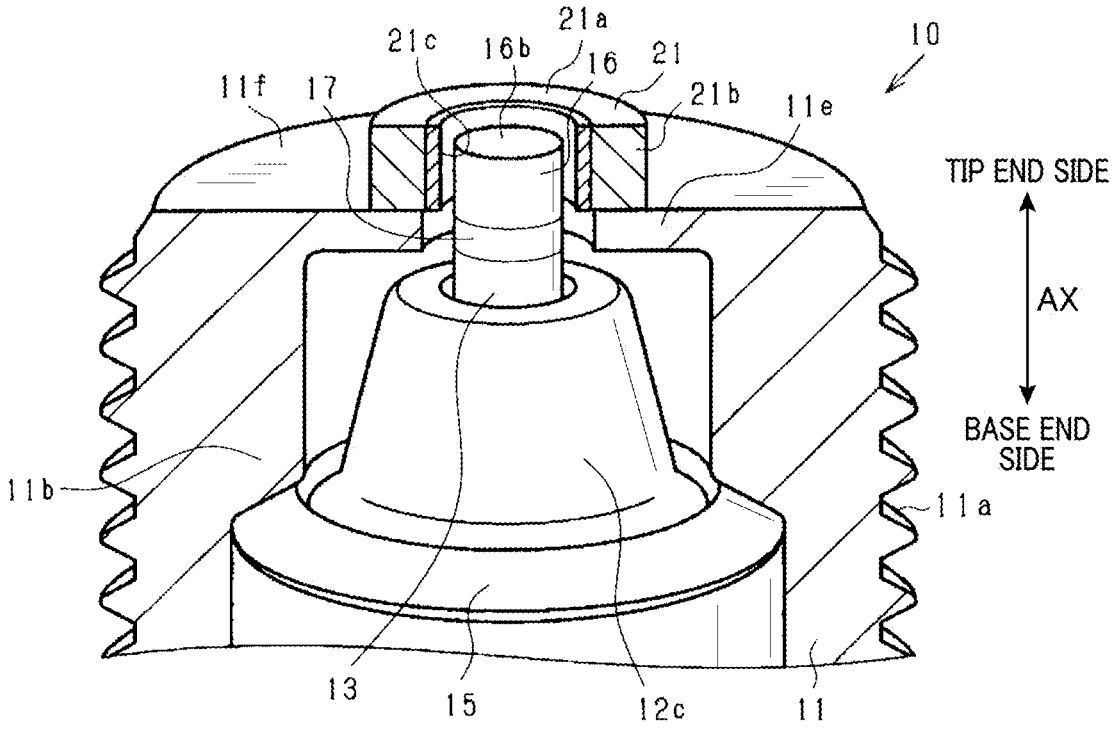
FIG. 2 is a cross-sectional perspective view of a vicinity of a tip end of the spark plug according to the embodiment.

As shown in FIG. 2, the ground electrode 21 is arranged so as to protrude towards the tip end side from the tip end surface 11*f* of the small diameter portion 11*e* of the housing 11. An outer diameter of the ground electrode 21 is greater than the inner diameter of the small diameter portion 22*e* and smaller than an outer diameter of the tip end surface 11*f* of the housing 11. The inner diameter of the ground electrode 21 is smaller than the inner diameter of the small diameter portion 11*e* of the housing 11. An inner peripheral surface of the ground electrode 21 is positioned further towards the inner side in the radial direction than an inner peripheral surface of the small diameter portion 11*e* of the housing, over the overall circumference.

The ground electrode 21 includes a circular-cylindrical (annular) electrode base material 21*b* and a noble metal layer 21*c* that is provided in an inner peripheral edge portion of the electrode base material 21*b*. For example, the electrode base material 21*b* includes a nickel (Ni)-based alloy. The noble metal layer 21*c* includes a simple substance, such as platinum (Pt) or iridium (Ir), or an alloy thereof. In addition, the noble metal layer 21*c* is diffusion-bonded to the electrode base material 21*b*. For example, a thickness of the noble metal layer 21*c* is 0.1 mm to 0.5 mm. Here, the noble metal layer 21*c* may be joined by welding to the electrode base material 21*b*.

The center electrode 13 is inserted into the interior of the insulator 12 and held. The center electrode 13 is formed into a circular-columnar shape with an Ni alloy that has superior heat resistance and the like as a base material. Specifically, an inner material (core material) of the center electrode 13 includes copper, and an outer material (outer shell material) includes the Ni alloy.

The center electrode 13 includes a circular-columnar noble metal tip 16 at a tip end thereof. For example, an outer diameter of the noble metal tip 16 is 2.4 mm. For example, a length in the axial direction AX is 3.0 mm. A welding portion 17 is formed between an outer material of the center electrode 13 and the noble metal tip 16. The welding portion 17 (fused portion) is a portion that is formed when the noble metal tip 16 is laser-welded (welded) onto the tip end of the outer material. The welding portion 17 includes the components of the outer material and the components of the noble metal tip 16. The noble metal tip 16 protrudes further than the tip end of the insulator 12.

The ground electrode 21 is arranged so as to oppose an outer peripheral surface of the noble metal tip 16. On a cross-section that includes the center axis C, the inner peripheral surface of the ground electrode 21 is parallel to the outer peripheral surface of the noble metal tip 16. The tip end surface 21*a* of the ground electrode 21 is arranged further towards the tip end side than a tip end surface 16*b* of the noble metal tip 16 is. A spark gap is formed between the outer peripheral surface of the noble metal tip 16 and the inner peripheral surface of the ground electrode 21, over the overall circumference.

For example, a distance between the inner peripheral surface of the ground electrode 21 and the outer peripheral surface of the center electrode 13, that is, a width of the spark gap is equal to or greater than 0.25 mm and equal to or less than 0.6 mm. In addition, discharge is generated between the outer peripheral surface of the noble metal tip 16 and the inner peripheral surface of the ground electrode 21, and a discharge spark is formed.

Figure 4:
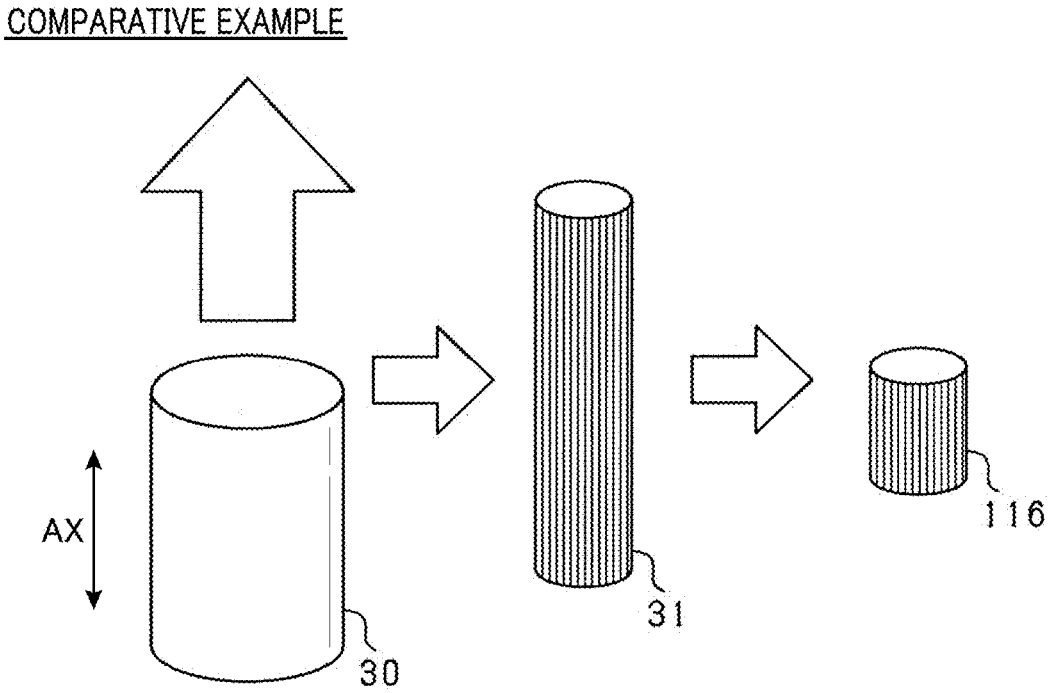
FIG. 4 is a schematic diagram illustrating a manufacturing process for a noble metal tip of a comparative example.

FIG. 4 is a schematic diagram of a manufacturing process of a noble metal tip 116 of a comparative example. An Ir-alloy material 30 is formed from an Ir alloy into a circular-columnar shape. For example, a composition of the Ir alloy is 90 weight percent (wt %) Ir and 10 wt % Rh.

For example, the Ir-alloy material 30 is stretched in the axial direction AX by a drawing machine and an Ir-alloy material 31 of which an outer diameter is adjusted to a predetermined outer diameter is formed. The predetermined outer diameter is an outer diameter that is equal to the outer diameter of the above-described noble metal tip 16 and is 2.4 mm.

Next, for example, the Ir-alloy material 31 is cut by shearing so that the length in the axial direction AX is a prescribed length. The noble metal tip 116 is thereby formed. The prescribed length is a length that is equal to the length in the axial direction AX of the noble metal tip 16 and is, for example, 3.0 mm.

Figure 5:
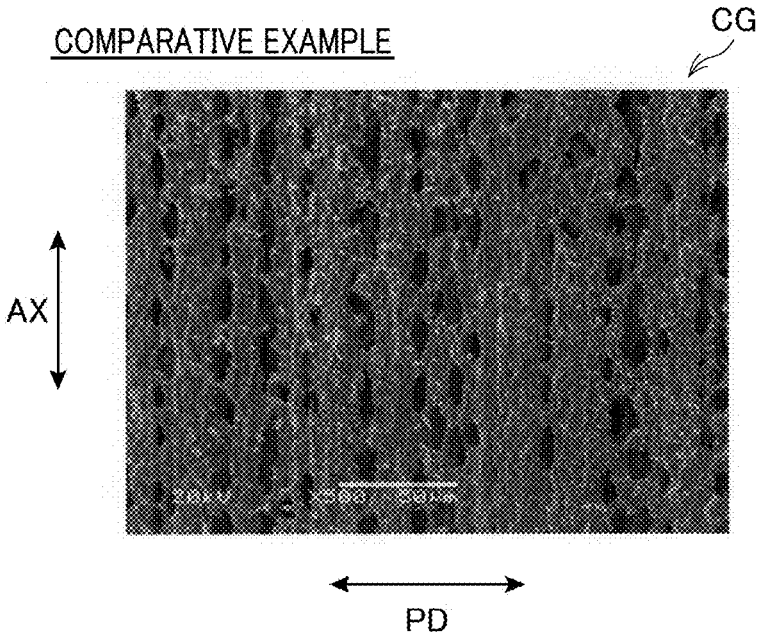
FIG. 5 is an SEM photograph illustrating a crystal structure of the noble metal tip of the comparative example.

FIG. 5 is a scanning electron microscope (SEM) photograph of a crystal structure of the noble metal tip 116 of the comparative example. The photograph captures a cross-section that is parallel to the axial direction AX of the noble metal tip 116 and within 1 mm from the outer peripheral surface of the noble metal tip 116. An up/down direction in FIG. 5 is the stretching direction of the Ir-alloy material 30 that is directed along the axial direction AX. The crystal structure of the noble metal tip 116 is in the form of fibers that run along the stretching direction.

Here, in FIG. 5, an aspect ratio of the respective crystal grains CG is a value that is obtained by a length of the respective crystal grains CG in the axial direction AX of the noble metal tips 16 and 116 being divided by a length of the respective crystal grains CG in a direction PD perpendicular to the axial direction AX. A cross-section that is parallel to the axial direction AX of the noble metal tip 116 and within 1 mm from the outer peripheral surface of the noble metal tip 116 was observed. In addition, an average aspect ratio (average value of the aspect ratios) of the crystal grains CG within a 500 μm×500 μm area on the cross-section was calculated. As a result, the average aspect ratio of the crystal grains CG in the noble metal tip 116 was approximately 15 (10 or greater).

When the noble metal tip 116 is exposed to high temperatures through use of the spark plug 10, an oxide of Ir is formed on a grain boundary portion of the Ir alloy in the noble metal tip 116. Because the Ir oxide tends to be volatile at high temperatures, volatilization of the Ir oxide progresses in accompaniment with use of the spark plug 10.

Figure 6:
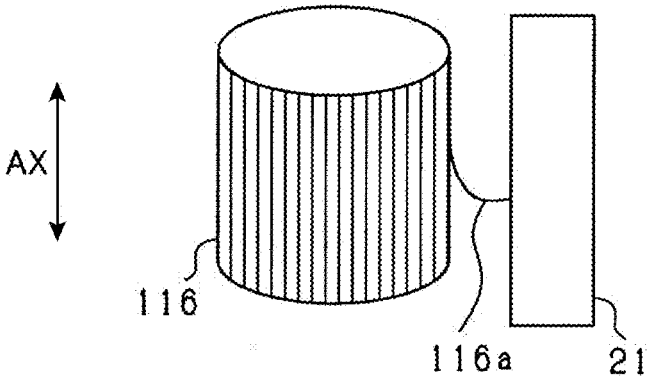
FIG. 6 is a schematic diagram illustrating a state in which an outer peripheral surface of the noble metal tip of the comparative example is finely split.

Furthermore, it has been found that, when gas rapidly expands as a result of heat from discharge and impact force is applied to the noble metal tip 116, the outer peripheral surface of the noble metal tip 116 becomes finely split as shown in FIG. 6. The inventors of the present application have noticed that, as a result, a fibrous structure 116*a* may come into contact with the ground electrode 21. A short circuit may thereby occur between the center electrode 13 and the ground electrode 21.

Here, according to the present embodiment, the above-described Ir-alloy material 31 is recrystallized by a heating process, and the average aspect ratio of the crystal grains of the Ir alloy in the Ir-alloy material 31 is adjusted to be equal to or greater than 1.3 and equal to or less than 4.8. Preferably, the average aspect ratio of the crystal grains of the Ir alloy in the Ir-alloy material 31 is adjusted to be equal to or greater than 2.0 and equal to or less than 4.8.

Recrystallization of the Ir alloy starts at approximately 1000° C. In addition, when the temperature becomes higher than 1400° C., the speed of recrystallization of the Ir alloy becomes excessively fast. In this regard, in the heating process, the Ir-alloy material 31 is heated to a temperature that is equal to or greater than 1000° C. and equal to or less than 1400° C. and recrystallized. Preferably, in the heating process, the Ir-alloy material 31 is heated to a temperature that is equal to or greater than 1100° C. and equal to or less than 1200° C. and recrystallized.

Here, when the temperature at which the Ir-alloy material 31 is heated is too low, the speed of recrystallization of the Ir alloy becomes slow. An amount of time required for the average aspect ratio of the crystal grains to be adjusted becomes long. Meanwhile, when the temperature at which the Ir-alloy material 31 is heated is too high, the speed of recrystallization of the Ir alloy becomes excessively fast. The average aspect ratio of the crystal grains becomes unstable. In this regard, the Ir-alloy material 31 is heated for 30 minutes at 1150° C. and recrystallized. Here, when the heating temperature is lower than 1150° C., the heating time may be longer than 30 minutes. When the heating temperature is higher than 1150° C., the heating time may be shorter than 30 minutes.

Subsequently, the Ir-alloy material 31 is cut such that the length in the axial direction AX is 3.0 mm (prescribed length). The noble metal tip 16 is thereby formed.

Figure 7:
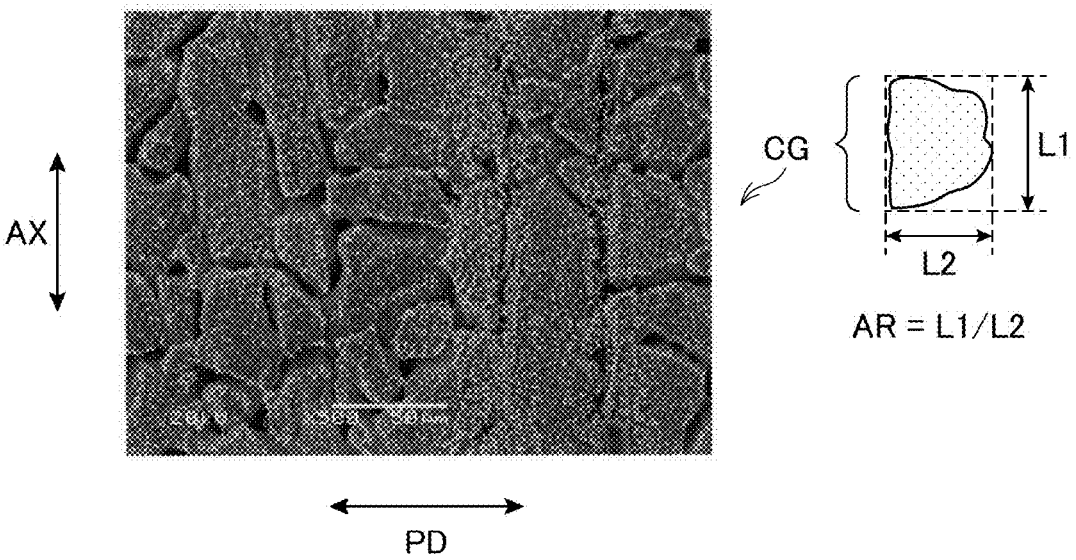
FIG. 7 is an SEM photograph illustrating a crystal structure of a noble metal tip according to an embodiment.

FIG. 7 is an SEM photograph of a crystal structure of the noble metal tip 16. The photograph captures a cross-section that is parallel to the axial direction AX of the noble metal tip 16 and within 1 mm from the outer peripheral surface of the noble metal tip 16. An up/down direction in FIG. 7 is the stretching direction of the Ir-alloy material 30. The crystal structure of the noble metal tip 16 is polycrystalline as a result of recrystallization.

Here, as shown n FIG. 7, an aspect ratio AR of the respective crystal grains CG is a value that is obtained by a length L1 of the respective crystal grains CG in the axial direction AX of the noble metal tips 16 being divided by a length L2 of the respective crystal grains CG in a direction PD perpendicular to the axial direction AX (i.e., AR=L1/

L2). A cross-section that is parallel to the axial direction AX of the noble metal tip 16 and within 1 mm from the outer peripheral surface of the noble metal tip 16 was observed. In addition, the average aspect ratio of the crystal grains CG within a 500 μm×500 μm area on the cross-section was calculated. As a result, the average aspect ratio of the crystal grains CG of the noble metal tip 16 was approximately 3.

Figure 8:
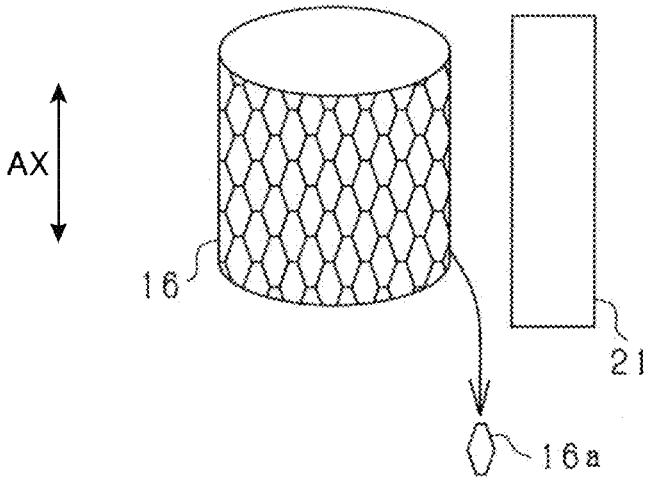
FIG. 8 is a schematic diagram illustrating a state in which a structure on an outer peripheral surface of the noble metal tip detaches.

When the average aspect ratio of crystal grains of the Ir alloy in the noble metal tip 16 is equal to or less than 4.8, the holding force between the crystal grains weakens, compared to that when the average aspect ratio of the crystal grains is equal to or greater than 10. The inventors of the present application have found that, as a result, as shown in FIG. 8, a structure 16*a* that has peeled off from the outer peripheral surface of the noble metal tip 16 detaches without coming into contact with the ground electrode 21.

Meanwhile, the inventors of the present application have found that, when the average aspect ratio of the crystal grains of the Ir alloy in the noble metal tip 16 is less than 1.3, the structure 16*a* excessively peels off from the outer peripheral surface of the noble metal tip 16. The noble metal tip 16 easily deteriorates.

Figure 9:
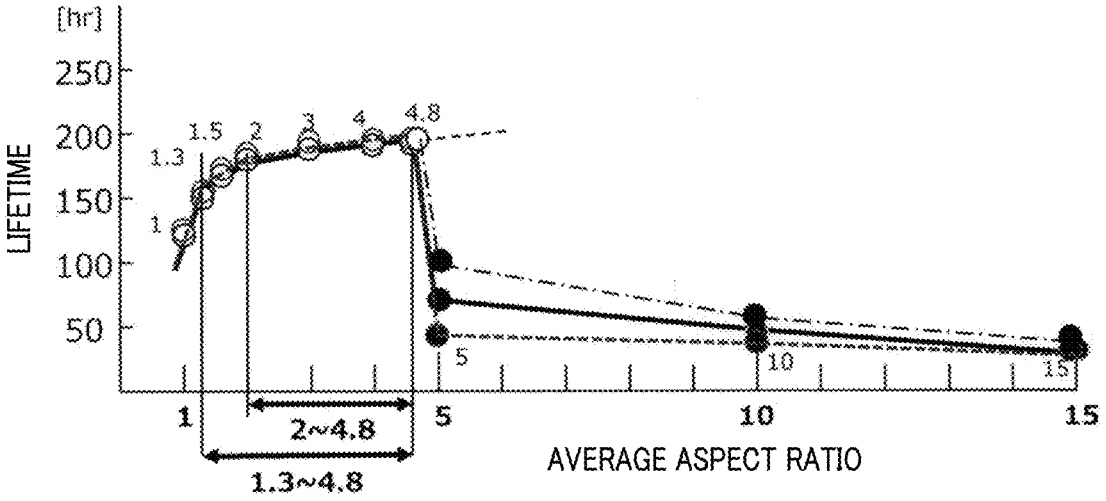
FIG. 9 is a graph illustrating a relationship between an average aspect ratio (that is an average value of aspect ratios of crystal grains of an Ir alloy in the noble metal tip) and a lifetime of the spark plug.

FIG. 9 is a graph of a relationship between the average aspect ratio (an average value of aspect ratios of crystal grains of the Ir alloy) and a lifetime of the spark plug 10. Here, the lifetime refers to a point in time when a short circuit occurs between the noble metal tip (center electrode 13) and the ground electrode 21 or a point in time when the width of the gap between the noble metal tip and the ground electrode 21 increases by 0.02 mm from an initial state (the start of use) of the spark plug 10.

In FIG. 9, a case in which the lifetime is reached as a result of a short circuit is indicated by a black circle, and a case in which the lifetime is reached by a gap increase is indicated by a white circle. In addition, a case in which the gap width at the initial state is 0.25 mm is indicated by a broken line. A case in which the gap width at the initial state is 0.4 mm is indicated by a solid line. A case in which the gap width at the initial state is 0.6 mm is indicated by a single-dot chain line.

Testing conditions regarding lifetime are as follows. A rotation speed of the internal combustion engine is 1500 rpm, a load thereof is 100%, and a fuel thereof is natural gas. The internal combustion engine has 12 cylinders and a total displacement volume of 74.9 L. Under these conditions, the above-described gap width and the above-described average aspect ratio were changed, and the lifetime of the spark plug 10 of a single cylinder was evaluated.

A noble metal tip of which the average aspect ratio is 15 corresponds to the noble metal tip 116 of the comparative example. At the average aspect ratio of 15, the lifetime was reached as a result of a short circuit at approximately 50 hours when the gap width at the initial state was any of 0.25 mm, 0.4 mm, and 0.6 mm. A reason for this is that, as shown in FIG. 6, the fibrous structure 116*a* comes into contact with the ground electrode 21 and a short circuit occurs between the center electrode 13 and the ground electrode 21.

When the heating process is performed and the average aspect ratio of the noble metal tip is reduced to 5, the lifetime gradually increases. However, the lifetime was reached as a result of a short circuit when the gap width at the initial state was any of 0.25 mm, 0.4 mm, and 0.6 mm. In this case as well, the lifetime was reached as a result of the occurrence of a short circuit, shown in FIG. 6. In addition, the lifetime increases as the gap width at the initial state widens. A reason for this is that the amount of time until the short circuit shown in FIG. 6 occurs increases as the gap width at the initial state widens.

When the heating process is performed and the average aspect ratio of the noble metal tip is further reduced, the short circuit no longer occurs when the average aspect ratio is equal to or less than 4.8. A reason for this is that, as shown in FIG. 8, the structure 16*a* that has peeled off from the outer peripheral surface of the noble metal tip 16 detaches without coming into contact with the ground electrode 21.

The lifetime is reached as a result of a gap increase when the average aspect ratio ranges from 4.8 to 1.0. The lifetime gradually shortens from the average aspect ratio of 4.8 to 1.3. A reason for this is that, when the crystal grains grow as a result of recrystallization, the holding force between the crystal grains weakens. The structure easily peels off from the outer peripheral surface of the noble metal tip. When the average aspect ratio decreases below 1.3, the lifetime rapidly shortens. A reason for this is that the holding force between the crystal grains further weakens.

The structure excessively peels off from the outer peripheral surface of the noble metal tip, and the noble metal tip easily deteriorates. When the average aspect ratio ranges from 4.8 to 1.0, a similar tendency is exhibited even when the gap width at the initial state is any of 0.25 mm, 0.4 mm, and 0.6 mm. A reason for this is that the gap width at the initial state has little bearing on the amount of time until the gap width increases by 0.02 mm from the initial state.

According to the present embodiment described in detail above, the following advantages are achieved.

In the noble metal tip 16, the average aspect ratio of the crystal grains of the Ir alloy is adjusted to be equal to or greater than 1.3 and equal to or less than 4.8. When the average aspect ratio of crystal grains of the Ir alloy is equal to or less than 4.8, the holding force between the crystal grains weakens compared to that when the aspect ratio is equal to or greater than 10.

The inventors of the present application have found that, as a result, the structure 16*a* that peels off from the outer peripheral surface of the noble metal tip 16 detaches without coming into contact with the ground electrode 21 that opposes the outer peripheral surface. Therefore, a short circuit between the noble metal tip 16 and the ground electrode 21 can be suppressed.

Meanwhile, when the average aspect ratio of crystal grains of the Ir alloy is less than 1.3, the inventors of the present application have found that the structure 16*a* excessively peels off from the outer peripheral surface of the noble metal tip 16, and the noble metal tip 16 easily deteriorates. Therefore, as a result of the average aspect ratio of crystal grains of the Ir alloy being adjusted to be equal to or greater than 1.3, deterioration of the noble metal tip 16 can be suppressed.

In the noble metal tip 16, the average aspect ratio of crystal grains of the Ir alloy is adjusted to be equal to or greater than 2.0 and equal to or less than 4.8. According to this configuration, peeling of the structure 16*a* from the outer peripheral surface of the noble metal tip 16 can be further suppressed. Deterioration of the noble metal tip 16 can be further suppressed.

The inventors of the present application have confirmed that substantially similar effects are achieved when, in the initial state (at the start of use) of the spark plug 10, the distance between the outer peripheral surface of the noble metal tip 16 and the ground electrode 21 is any of 0.25 mm, 0.4 mm, and 0.6 mm. Therefore, in the spark plug 10 in which the distance between the outer peripheral surface of the noble metal tip 16 and the ground electrode 21 is set to be equal to or greater than 0.25 mm and equal to or less than 0.6 mm in the initial state of the spark plug 10, a short circuit between the noble metal tip 16 and the ground electrode 21 can be suppressed.

The noble metal tip 16 is stretched and formed into the circular-columnar shape that has a predetermined outer diameter. In the noble metal tip 16, the aspect ratios of crystal grains are adjusted. Thus, the outer diameter of the noble metal tip 16 can be adjusted to the predetermined outer diameter. In addition, a short circuit between the noble metal tip 16 and the ground electrode 21 can be suppressed.

The Ir-alloy material 30, having circular-columnar shape, is stretched in the axial direction AX and the outer diameter of the Ir-alloy material 30 is adjusted to a predetermined outer diameter. Subsequently, the Ir-alloy material 31 is recrystallized by the heating process, and the average aspect ratio of crystal grains of the Ir alloy in the Ir-alloy material 31 is adjusted to be equal to or greater than 1.3 and equal to or less than 4.8. In addition, the Ir-alloy material 31 is cut such that the length in the axial direction AX is a prescribed length, and the noble metal tip 16 is formed. Therefore, the noble metal tip 16 of which the aspect ratios of crystal grains of the Ir alloy are adjusted can be manufactured.

In the heating process, the Ir-alloy material 31 is heated to a temperature that is equal to or greater than 1000° C. and equal to or less than 1400° C. and recrystallized. Therefore, the Ir-alloy material 31 can be recrystallized and the average aspect ratio of crystal grains of the Ir alloy can be easily stabilized.

In the heating process, the Ir-alloy material 31 is heated to a temperature that is equal to or greater than 1100° C. and equal to or less than 1200° C. and recrystallized. As a result of the above-described process, the average aspect ratio of crystal grains of the Ir alloy can be easily stabilized while increase in the amount of time required for the adjustment of the average aspect ratio can be suppressed.

Here, the above-described embodiment can be modified in the following manner. Sections that are identical to those according to the above-described embodiment are given the same reference numbers. Descriptions thereof are omitted.

The prescribed length that is the length of the noble metal tip 16 in the axial direction AX is not limited to 3 mm, and may be equal to or greater than 2 mm and equal to or less than 4 mm. The evaluation results regarding lifetime indicate tendencies similar to those according to the above-described embodiment even at such prescribed lengths.

According to the above-described embodiment, the material 31 of which the aspect ratios are adjusted by the heating process is cut. However, the aspect ratios may be adjusted by the heating process after the Ir-alloy material 31 is cut.

The composition of the Ir alloy may be 73 wt % Ir and 27 wt % Rh. Even in the noble metal tip 16 that is manufactured from the Ir alloy of the foregoing composition, effects similar to those according to the above-described embodiment can be achieved. In addition, a metal other than Rh can also be added to the Ir alloy.

The ground electrode 21 may not include the noble metal layer 21*c*. The ground electrode 21 is not limited to the circular-cylindrical shape (annular shape) and may be configured by a plurality of circular-arc-shaped portions that oppose the noble metal tip 16. Alternatively, the ground electrode 21 may be configured to have a four-legged shape or a three-legged shape (have a plurality of legs) that oppose the noble metal tip 16.

What is claimed is:

1. A spark plug comprising:

a noble metal tip that includes an Ir-alloy material and has a circular-columnar shape that has a predetermined outer diameter and is formed by the Ir-alloy material being stretched; and a ground electrode that is arranged so as to oppose an outer peripheral surface of the noble metal tip, the noble metal tip being uncoated around the outer peripheral surface of the noble metal tip such that the ground electrode is arranged to directly oppose the outer peripheral surface of the noble metal tip without an intervening layer, the spark plug being configured to generate discharge between the noble metal tip and the ground electrode, and the Ir-alloy material in the noble metal tip including crystal grains of an Ir alloy having an average aspect ratio that is adjusted to be equal to or greater than 2.0 and equal to or less than 4.8, the average aspect ratio being an average value of aspect ratios of the crystal grains each being a value that is obtained by a length of the respective crystal grains in an axial direction of the noble metal tip being divided by a length of the respective crystal grains in a direction perpendicular to the axial direction.

2. The spark plug according to claim 1, wherein:

in an initial state of the spark plug, a distance between the outer peripheral surface of the noble metal tip and the ground electrode is set to be equal to or greater than 0.25 mm and equal to or less than 0.6 mm.

3. The spark plug according to claim 1, wherein:

a length of the noble metal tip in the axial direction is equal to or greater than 2 mm and equal to or less than 4 mm.

4. The spark plug according to claim 2, wherein:

a length of the noble metal tip in the axial direction is equal to or greater than 2 mm and equal to or less than 4 mm.

5. The spark plug according to claim 1, wherein:

the ground electrode has an annular shape such that an inner peripheral surface of the ground electrode directly opposes the outer peripheral surface of the noble metal tip.

6. The spark plug according to claim 5, wherein:

a tip end surface of the ground electrode is arranged further towards a tip end side of the spark plug than a tip end surface of the noble metal tip is.

7. A noble metal tip comprising:

an Ir-alloy material, the noble metal tip having a circular-columnar shape that has a predetermined outer diameter and is formed by the Ir-alloy material being stretched, the noble metal tip being uncoated around the predetermined outer diameter, and the Ir-alloy material in the noble metal tip including crystal grains of an Ir alloy having an average aspect ratio that is adjusted to be equal to or greater than 2.0 and equal to or less than 4.8, the average aspect ratio being an average value of aspect ratios of the crystal grains each being a value that is obtained by a length of the respective crystal grains in an axial direction of the noble metal tip being divided by a length of the respective crystal grains in a direction perpendicular to the axial direction.

8. The noble metal tip according to claim 7, wherein:

a length of the noble metal tip in the axial direction is equal to or greater than 2 mm and equal to or less than 4 mm.

9. A method for manufacturing a noble metal tip having a circular-columnar shape from an Ir alloy, the method comprising:

stretching an Ir-alloy material in the noble metal tip, having a circular-columnar shape, in the axial direction to adjust an outer diameter to a predetermined outer diameter;

recrystallizing the Ir-alloy material, by a heating process, to adjust an average aspect ratio of crystal grains of an Ir alloy of the Ir alloy material to be equal to or greater than 2.0 and equal to or less than 4.8, the average aspect ratio being an average value of aspect ratios of the crystal grains each being a value that is obtained by a length of the respective crystal grains in an axial direction of the noble metal tip being divided by a length of the respective crystal grains in a direction perpendicular to the axial direction; and cutting the Ir-alloy material, such that a length in the axial direction is a prescribed length, to form the noble metal tip, wherein the noble metal tip is uncoated around the predetermined outer diameter.

10. The method for manufacturing the noble metal tip according to claim 9, wherein:

in the heating process, the Ir-alloy material is heated to a temperature that is equal to or greater than 1000° C. and equal to or less than 1400° C. for recrystallization.

11. The method for manufacturing the noble metal tip according to claim 9, wherein:

in the heating process, the Ir-alloy material is heated to a temperature that is equal to or greater than 1100° C. and equal to or less than 1200° C. for recrystallization.

12. The method for manufacturing the noble metal tip according to claim 10, wherein:

in the heating process, the Ir-alloy material is heated to a temperature that is equal to or greater than 1100° C. and equal to or less than 1200° C. for recrystallization.

* * * * *